US010125626B2

(12) United States Patent
Bell et al.

(10) Patent No.: US 10,125,626 B2
(45) Date of Patent: Nov. 13, 2018

(54) SEAL ARRANGEMENT

(71) Applicant: SIEMENS AKTIENGESELLSCHAFT, München (DE)

(72) Inventors: Ralf Bell, Mülheim an der Ruhr (DE); Isabell Böer, Mülheim an der Ruhr (DE); Giuseppe Gaio, Bonn (DE); Raimund Heinze, Oberhausen (DE); Markus Legenbauer, Essen (DE); Damian Razowski, Mülheim an der Ruhr (DE); Thomas Riedel, Mülheim an der Ruhr (DE); Stanislaw Ruda, Moers (DE); Ralf Ziwes, Dinslaken (DE)

(73) Assignee: SIEMENS AKTIENGESELLSCHAFT (DE)

( * ) Notice: Subject to any disclaimer, the term of this patent is extended or adjusted under 35 U.S.C. 154(b) by 755 days.

(21) Appl. No.: 14/514,871

(22) Filed: Oct. 15, 2014

(65) Prior Publication Data

US 2015/0110620 A1 Apr. 23, 2015

(30) Foreign Application Priority Data

Oct. 18, 2013 (EP) ..... 13189280

(51) Int. Cl.
*F01D 11/00* (2006.01)

(52) U.S. Cl.
CPC ..... *F01D 11/005* (2013.01); *F05D 2230/80* (2013.01); *F05D 2240/57* (2013.01)

(58) Field of Classification Search
CPC ..... F01D 11/003; F01D 11/005; F01D 25/26; F01D 25/265
See application file for complete search history.

(56) References Cited

U.S. PATENT DOCUMENTS 5,104,286 A * 4/1992 Donlan ..... F01D 25/30 277/641
6,648,332 B1 11/2003 Burdgick
(Continued)

FOREIGN PATENT DOCUMENTS

CN 1619109 A 5/2005
CN 102378850 A 3/2012
(Continued)

OTHER PUBLICATIONS

Chinese Office Action, dated Feb. 3, 2017, issued in corresponding Chinese Patent Application No. 201410558534.6. English translation. Total pp. 10.
(Continued)

*Primary Examiner* — Justin Seabe
(74) *Attorney, Agent, or Firm* — Ostrolenk Faber LLP

(57) ABSTRACT

A seal arrangement (15; 26; 43; 50) for sealing an annular gap (14) between a high-pressure steam space (12) and an adjacent low-pressure steam space (13). The gap is defined between two turbine casings (10, 11) each split into two casing halves, the seal arrangement (15; 26; 43; 50) has a seal element (24; 47; 58) which is formed in a segmented and annular manner and extends between the two turbine casings (10, 11) and engages in an annular receiving groove (9, 23; 30, 34; 49; 54) by means of at least one of its radial end regions. The seal arrangement (15; 26; 43; 50) has at least one segmented ring (16, 20; 27, 31; 44; 51; 55) with a first circumferential surface (17, 21; 28, 32; 45; 52, 56) releasably attached to one of the turbine casings (10, 11) in the region of the annular gap (14), and has an opposite second circumferential surface (18, 22; 29, 33; 46; 53, 57) with the annular receiving groove (9, 23; 30, 34; 54) or, in a one-piece form, with the radially projecting annular seal element (47; 58).

10 Claims, 3 Drawing Sheets

(56) References Cited

U.S. PATENT DOCUMENTS

| | | | | |
|---|---|---|---|---|
| 7,001,145 | B2 | 2/2006 | Couture | 415/173.4 |
| 8,920,121 | B2 | 12/2014 | Dungs | |
| 9,464,535 | B2 * | 10/2016 | Takagi | F01D 11/003 |
| 2011/0164965 | A1 * | 7/2011 | Smith | F01D 11/005<br>415/182.1 |
| 2013/0104565 | A1 * | 5/2013 | Casavant | F01D 25/26<br>60/805 |
| 2013/0181408 | A1 | 7/2013 | Pakkala | 273/347 |

FOREIGN PATENT DOCUMENTS

| | | | |
|---|---|---|---|
| EP | 2351910 | 8/2011 | |
| EP | 2410128 | 1/2012 | |
| FR | 1038162 A * | 9/1953 | F01D 11/005 |

OTHER PUBLICATIONS

EP Search Report dated Dec. 16, 2013 corresponding to 2013P13280EP. (4 pages).

* cited by examiner

SEAL ARRANGEMENT

CROSS-REFERENCE TO RELATED APPLICATIONS

The present application claims priority of European Patent Application No. EP 13189280, filed Oct. 18, 2013, the contents of which are incorporated by reference herein.

TECHNICAL FIELD

The present invention relates to a seal arrangement for sealing an annular gap between a high-pressure steam space and an adjacent low-pressure steam space, which gap is defined between two turbine casings, with each casing split into two casing halves.

TECHNICAL BACKGROUND

The seal arrangement has a seal element which is formed in a segmented and annular manner. In its intended state, the seal extends between the two turbine casings and engages in an annular receiving groove by means of at least one of its radial end regions. Furthermore, the invention relates to the use of such a seal arrangement for sealing an annular gap between a high-pressure steam space and an adjacent low-pressure steam space, to a turbine having at least two turbine casings, in each case split into two casing halves, which between them form a high-pressure steam space and a low-pressure steam space, wherein the steam spaces are separated from one another by an annular gap defined between the turbine casings, and to a method for repairing a worn seal arrangement of the abovementioned type.

In steam turbines, normally annular seal elements are used to seal annular gaps between two mutually adjacent steam spaces. The gaps are defined between two turbine casings in each case split into two casing halves. The seal elements normally have an I-shaped cross section and are split into two segments to enable them to be mounted. In the intended arranged state, the mutually opposite radial end regions of the annular seal elements engage in annular receiving grooves formed opposite one another on the turbine casings or on their respective casing halves. When the turbine is in operation, the seal elements and in particular the annular receiving grooves are subjected to wear phenomena due to steam erosion and due to mechanical loads. Repair of the seal elements is not economically possible. As a result, these elements have to be replaced. Reconditioning the annular receiving grooves involves considerable effort, with associated high costs. This effort is difficult to reduce since it is impossible to determine in advance, with any precision, the point at which repairs are going to be necessary. One known way of counteracting the wear due to erosion consists in selecting an appropriate material. However, this also involves very high costs.

SUMMARY OF THE INVENTION

Proceeding from this prior art, it is an object of the present invention to provide a seal arrangement of the type mentioned in the introduction, which has an alternative construction, is cost-effective to produce and offers problem-free maintenance.

In order to achieve this object, the present invention provides a seal arrangement of the type mentioned in the introduction, which is characterized in that the seal arrangement has at least one segmented ring whose first circumferential surface is, in the intended state, releasably attached to one of the turbine casings in the region of the annular gap, and whose opposite second circumferential surface is provided either with the annular receiving groove or, in a one-piece form, with the radially projecting annular seal element. The principal advantage of the seal arrangement according to the invention lies in the fact that, during a major overhaul, for example after 100,000 operating hours, it is possible to entirely replace not only the seal element but also the at least one segmented ring. Accordingly, it is possible to dispense with inspection, assessment of the wear and onerous reconditioning work. Moreover, a targeted, plannable and cost-effective replacement solution is possible also for the second overhaul interval, which is beneficial for planning reliability with respect to the expenditure to be incurred and also with respect to the downtime.

According to a first variant of the present invention, the seal arrangement comprises a first ring whose first circumferential surface is, in the intended state, releasably attached to one of the turbine casings in the region of the annular gap, and whose opposite second circumferential surface is provided with the annular receiving groove, and a second ring whose first circumferential surface is, in the intended state, releasably attached, opposite the first ring, to the other turbine casing in the region of the annular gap, and whose opposite second circumferential surface is provided with an annular receiving groove, wherein the seal element is formed as a separate component and, in the intended state, engages in the annular receiving grooves of both rings. In other words, in this variant the seal arrangement comprises a three-part construction with two segmented rings, which on one hand serve for attaching to the turbine casings and on the other hand define the annular receiving grooves, and a seal element formed as a separate component which, in the intended arranged state, engages in both receiving grooves.

According to a second variant of the present invention, the seal arrangement comprises a first ring whose first circumferential surface is, in the intended state, releasably attached to one of the turbine casings in the region of the annular gap, and whose opposite second circumferential surface is provided with an annular receiving groove, and a second ring whose first circumferential surface is, in the intended state, releasably attached, opposite the first ring, to the other turbine casing in the region of the annular gap, and whose opposite second circumferential surface is formed with the radially projecting annular seal element, wherein the seal element formed in one piece with the second ring engages, in the intended state, in the annular receiving groove of the first ring. In this second variant, the seal arrangement thus comprises only two respectively segmented components, to wit a first ring with a one-piece radially projecting seal element, and a second ring that defines the annular receiving groove in which the seal element engages in the intended state.

Preferably, the ring or rings is/are made of steel, as is the seal element. By virtue of the fact that, in the case of an overhaul, the respective components are simply replaced with new components, it is possible to use cost-effective materials such as P265GH or 16Mo3, resulting in a cost-effective construction of the seal arrangement according to the invention.

According to one embodiment of the present invention, the seal element has, in the region of its free end, a rounded and widened end section which, in the intended state, engages in the associated annular receiving groove. The rounding ensures a good fit of the seal element in the associated annular receiving groove. If the seal element is a separate component, correspondingly formed end sections may then of course be provided at both free ends of the seal element.

According to one embodiment of the present invention, the end section is of substantially oval cross section. Particularly good results have been achieved with this shape.

In order to achieve the object stated in the introduction, the present invention also relates to the use of a seal arrangement according to the invention for sealing an annular gap between a high-pressure steam space and an adjacent low-pressure steam space of a turbine, which gap is defined between two turbine casings of the turbine in each case split into two casing halves.

Furthermore, in order to achieve the object stated in the introduction, the present invention provides a turbine having at least two turbine casings, in each case split into two casing halves, and between, the casings form a high-pressure steam space and a low-pressure steam space, wherein the steam spaces are separated from one another by an annular gap defined between the turbine casings, which gap is sealed by a seal arrangement according to the invention. The possible dividing of each casing into upper and lower parts is for mounting reasons. For example, a rotor is inserted in the lower pants and then the upper pants are mounted.

According to one embodiment of the present invention, the turbine is a low-pressure turbine.

Furthermore, the present invention provides a method for repairing a worn seal arrangement of a turbine according to the invention, in which the worn seal arrangement is replaced in its entirety with a new seal arrangement, in particular within the framework of a major overhaul of the turbine.

BRIEF DESCRIPTION OF THE DRAWINGS

Further features and advantages of the present invention will become apparent from the following description of embodiments of the present invention with reference to the appended drawing, in which.

DESCRIPTION OF EMBODIMENTS

In the following, identical reference numbers relate to identical or similar components.

Figure 1:
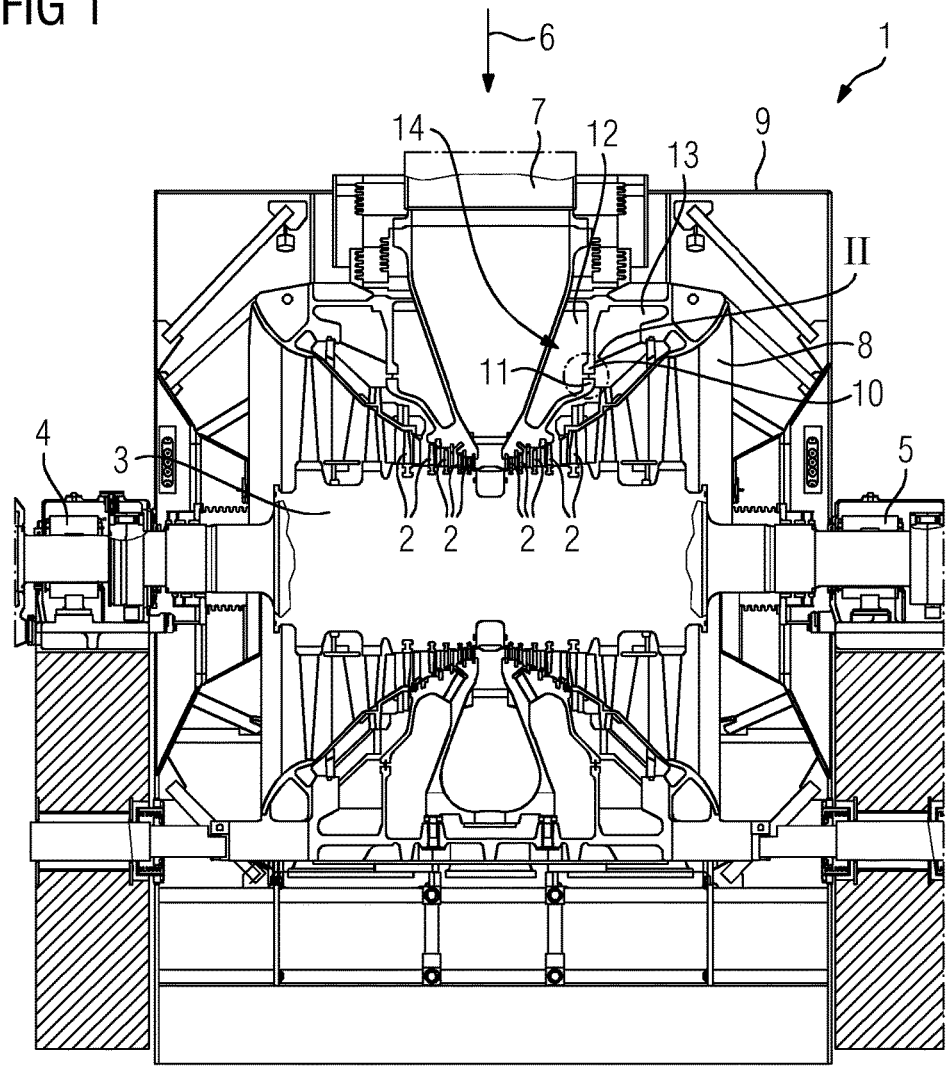
FIG. 1 shows a longitudinal section view of a low-pressure turbine.

FIG. 1 shows a turbine 1, specifically a low-pressure steam turbine. The turbine 1 comprises a rotor 3 which is provided with blades 2 and is mounted at its free ends with the aid of corresponding bearings 4 and 5. When the turbine 1 is in operation, steam flows in the direction of the arrow 6 into an inlet 7 and into the blading of the rotor 3, from which it leaves again through an outlet 8. The turbine 1 is enclosed by an outer casing 9. An outer inner casing 10 and an inner inner casing 11, extend around the rotor 3. Each casing 10 and 11 is split into two casing halves. In the present case, each is split into an upper casing half and a lower casing half. Both casing halves are provided inside the outer casing 9. The inner casings 10 and 11 define between them a high-pressure steam space 12 and a low-pressure steam space 13 which are separated from one another by an annular gap 14 remaining between the outer inner casing 10 and the inner inner casing 11. This annular gap 14 is sealed by means of a seal arrangement according to the invention, as is explained below with reference to FIGS. 2 to 5.

Figure 2:
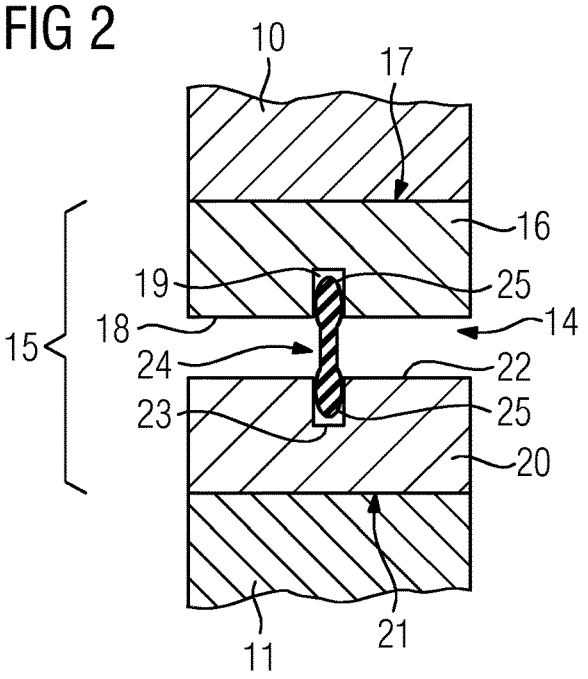
FIG. 2 shows an enlarged view of the section labeled with the reference sign II in FIG. 1, which shows a first variant of a seal arrangement according to the present invention.

FIG. 2 shows a first variant of a seal arrangement 15 according to the present invention. The seal arrangement 15 comprises a segmented first ring 16 having an outer circumferential surface 17 which is releasably attached to the outer inner casing 10 in the region of the annular gap 14 and having opposite inner circumferential surface 18 which is provided with an annular receiving groove 19. Furthermore, the seal arrangement 15 comprises a segmented second ring 20 having an inner circumferential surface 21 which is releasably attached, opposite the first ring 16, to the inner inner casing 11 in the region of the annular gap 14, and having an opposite outer circumferential surface 22 which is provided with an annular receiving groove 23. The respective receiving grooves 19 and 23 of the rings 16 and 20 are arranged radially opposite one another. The seal arrangement 15 comprises, as a third component, an annular segmented seal element 24 which is formed as a separate component. The seal element 24 is of substantially I-shaped cross section, wherein it is provided, at its two free ends, with rounded and widened end section 25 which are of substantially oval cross section These end sections 25 cause the seal element 24 engages in the receiving grooves 19 and 23 formed on the rings 16 and 20.

Figure 3:
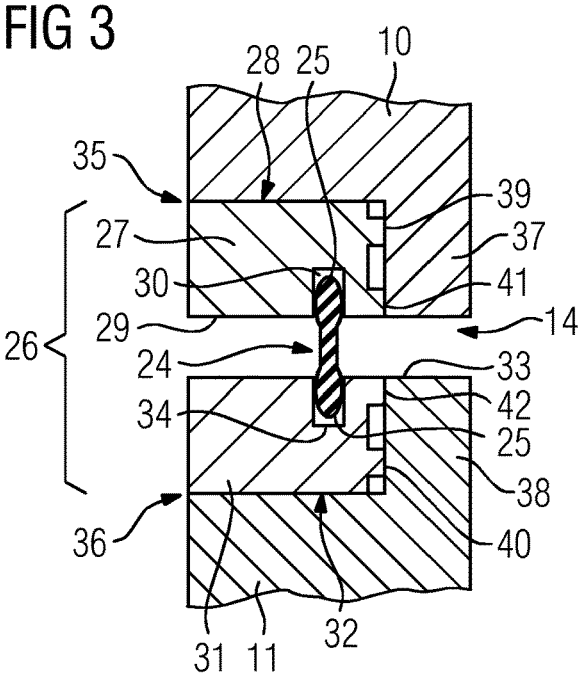
FIG. 3 shows an enlarged view of the section provided with the reference sign II in FIG. 1, which shows a second variant of a seal arrangement according to the present invention.

FIG. 3 shows a further variant of a seal arrangement 26 according to the invention. The seal arrangement 26 comprises a segmented first ring 27 which is made of metal. The outer circumferential surface 28 of the first ring 27 is releasably attached to the outer inner casing 10 in the region of the annular gap 14. The opposite inner circumferential surface 29 of the first ring 27 is provided with an annular receiving groove 30. Furthermore, the seal arrangement 26 comprises a segmented second ring 31 which is also made of metal. The inner circumferential surface 32 of the second ring 31 is releasably attached, opposite the first ring 27, to the inner inner casing 11, and the opposite outer circumferential surface 33 of the second ring 31 is provided with an annular receiving groove 34, wherein the receiving grooves 30 and 34 of the rings 27 and 31 are arranged radially opposite one another. The rings 27 and 31 are each received in annular recesses 35 and 36 of the inner casing 10 and 11, such that the respectively radially projecting projections 37 and 38 of the inner casings 10 and 11, formed by the recesses 35 and 36, form axial stops for the rings 27 and 31. The rings 27 and 31 are held in an improved manner on the inner casings 10 and 11. More precisely, each ring 27 and 31 comprises a respective supporting strip 39, 40 and a sealing strip 41, 42 which project axially as annular shoulders in the direction of the projections 37 and 38 and are spaced radially from one another, wherein the sealing strips 41, 42 project slightly further than the associated supporting strips 39, 40. The rings 27 and 31 can be attached in the respective recesses 35, 36 for example by means of attachment screws which are arranged distributed along the circumference of the rings 27, 31 and extend in the axial direction, between the respective supporting strip 39, 40 and sealing strip 41, 42, through the rings 27, 31 and are screwed into corresponding tapped bores (not shown) in the projections 37, 38. The seal arrangement 26 according to the second variant also has a seal element which is of substantially corresponding construction to the seal element of the first variant represented in FIG. 2, for which reason it is also indicated with the reference number 24 and is not described anew. The seal element 24 engages, with its end sections 25, in the receiving grooves 30 and 34 of the rings 27 and 31.

Figure 4:
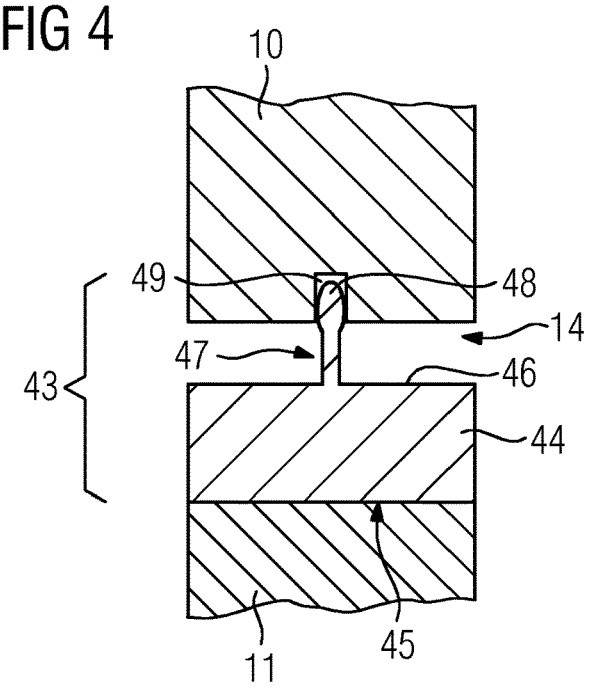
FIG. 4 shows an enlarged view of the section labeled with the reference sign II in FIG. 1, which shows a third variant of a seal arrangement according to the present invention.

FIG. 4 shows a seal arrangement 43 according to a third variant of the present invention. The seal arrangement 43 comprises a segmented ring 44 having an inner circumferential surface 45 which is releasably attached to the inner inner casing 11 in the region of the annular gap 14, and having an opposite outer circumferential surface 46 with an annular seal element 47, formed in one piece with the ring 44, projecting radially. The seal element 47 has, in the region of its free end, a rounded and widened end section 48 which is of substantially oval cross section. The seal arrangement 43 further comprises a receiving groove 49 in which the end section 48 of the seal element 47 engages, wherein in this variant the receiving groove 49 is created in the outer inner casing 10.

Figure 5:
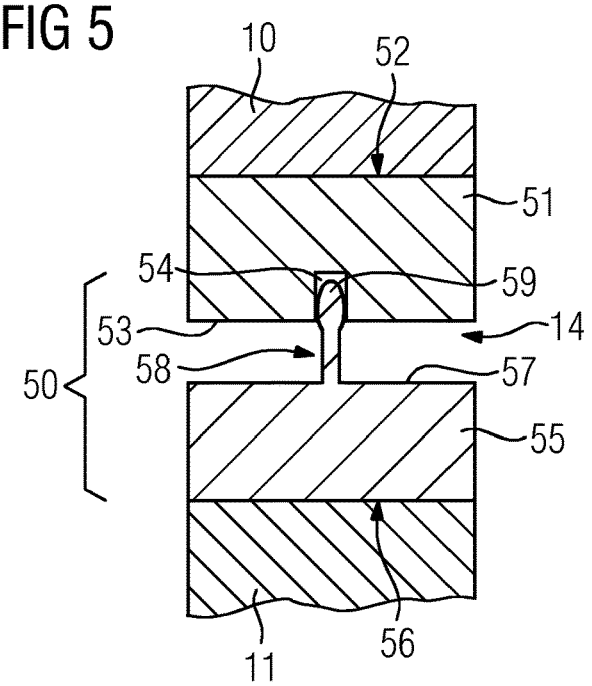
FIG. 5 shows an enlarged view of the section labeled with the reference sign II in FIG. 1, which shows a fourth variant of a seal arrangement according to the present invention.

FIG. 5 shows a seal arrangement 50 according to a fourth variant of the present invention. The seal arrangement 50 comprises a segmented first ring 51 having an outer circumferential surface 52 which is releasably attached to the outer inner casing 10 in the region of the annular gap 14 and having an opposite inner circumferential surface 53 which is provided with an annular receiving groove 54. Furthermore, the seal arrangement 50 comprises a segmented second ring 55 having an inner circumferential surface 56 which is releasably attached to the inner inner casing 11, and from the outer circumferential surface 57 there projects a radially projecting annular seal element 58, formed in one piece with the second ring 55. The seal element 58 has, at its free end, a rounded and widened end section 59 of oval cross section which engages in the receiving groove 54 of the first ring 51.

All rings and sealing elements of the above-described four variants are preferably each split centrally into two segments and are made of steel. The releasable attachment of the respective rings to the associated inner casings can be brought about by means of press-fitting, attachment screws or the like.

Although, FIGS. 2 to 5 respectively relate only to the section labeled II in FIG. 1, it other annular gaps of the turbine 1 may also be sealed with corresponding seal arrangements according to the invention.

An essential advantage associated with the seal arrangements 15, 26, 43 and 50 according to the invention consists in the fact that, within the framework of an overhaul, their individual components may, depending on the selected variant, be partially or entirely replaced with new components, whereby inspection, assessment and repair of the seal arrangements can be partially or entirely dispensed with. Costs may thus be reduced. Furthermore, replacing components, in contrast to testing and repair of the latter, is beneficial for planning reliability with respect to expenditure and downtime.

Although the invention has been illustrated and described in more detail by means of the preferred exemplary embodiment, the invention is not restricted by the disclosed examples and other variations may be derived herefrom by a person skilled in the art without departing from the scope of protection of the invention.

The invention claimed is:

1. A seal arrangement for a turbine for sealing an annular gap between a high-pressure steam space and an adjacent low-pressure steam space, wherein:

the gap is defined between two turbine casings;

each casing is split into two casing halves; and the seal arrangement comprises:

a seal element which is formed in a segmented manner and an annular manner around the high-pressure steam space, the seal element extending between the two turbine casings; the seal element having at least one radial end region configured to engage in at least one annular receiving groove of at least one of the casings; and at least one segmented ring having a first circumferential surface, releasably attached to one of the turbine casings in the region of the annular gap, the at least one segmented ring having an opposite second circumferential surface, the opposite second surface including either a surface forming the annular receiving groove or a surface of the seal element which projects radially from a remainder of the opposite second surface, wherein at least one segmented ring has a thickness between a bottom of the annular receiving groove and the one of the turbine casings in the region of the annular gap to which the at least one segmented ring is releasably attached or wherein the seal element is part of one segmented ring, and wherein the annular receiving groove has a constant width from a top of the annular receiving groove to a bottom of the annular receiving groove, the top of the annular receiving groove being an opening in the opposite second circumferential surface.

2. The seal arrangement as claimed in claim 1, wherein:

the at least one segmented ring comprises at least two segmented rings, and the at least one annular receiving groove comprises at least two annular receiving grooves;

a first one of the rings has a respective first circumferential surface releasably attached to one of the turbine casings in the region of the annular gap, and has an opposite second circumferential surface with a first one of the annular receiving grooves therein;

a second one of the rings has a respective first circumferential surface, that is releasably attached to the other turbine casing, the second ring being located opposite the first ring in the region of the annular gap, and the second ring having an opposite respective second circumferential surface with a second one of the annular receiving grooves; and the seal element is a separate component and has a respective one of the radial end regions at opposite ends of the seal element and the seal element end regions each engage in a respective one of the first and second annular receiving grooves of both rings.

3. The seal arrangement as claimed in claim 1, wherein:

the at least one segmented ring comprises at least two segmented rings, a first one of the rings has a first circumferential surface releasably attached to one of the turbine casings in the region of the annular gap, and has an opposite second circumferential surface with a first one of the at least one annular receiving groove therein;

a second one of the rings has a respective first circumferential surface which is releasably attached to the other turbine casing in the region of the annular gap and the second ring is located opposite the first ring; and the second ring has a respective opposite second circumferential surface including the surface of the seal element, the seal element end region of the second ring engaging in the annular receiving groove of the first ring.

4. The seal arrangement as claimed in claim 1, wherein the at least one ring is made of steel.

5. The seal arrangement as claimed in claim 1, wherein the seal element is made of steel.

6. The seal arrangement as claimed in claim 1, wherein the at least one radial end region of the seal element has a rounded and widened end section.

7. The seal arrangement as claimed in claim 6, wherein the end section of the seal element is of oval cross section.

8. A turbine having at least two turbine casings, each casing being split into two casing halves, the two turbine casings bordering a high-pressure steam space and a low-pressure steam space, the steam spaces being separated from one another by an annular gap defined between the turbine casings, the annular gap being sealed by a seal arrangement as claimed in claim 1.

9. The turbine as claimed in claim 8, wherein the turbine is a low-pressure turbine.

10. A method for repairing a seal arrangement, which is worn, for a turbine for sealing an annular gap between a high-pressure steam space and an adjacent low-pressure steam space, wherein:

the gap is defined between two turbine casings;

each casing is split into two casing halves;

the seal arrangement comprises:

a seal element which is formed in a segmented manner and an annular manner around the high-pressure steam space, the seal element extending between the two turbine casings; the seal element having at least one radial end region configured to engage in at least one annular receiving groove of at least one of the casings; and at least one segmented ring having a first circumferential surface, releasably attached to one of the turbine casings in the region of the annular gap, the at least one segmented ring having an opposite second circumferential surface, the opposite second surface including either a surface forming the annular receiving groove or a surface of the seal element which projects radially from a remainder of the opposite second surface; and the turbine has at least two turbine casings, each casing being split into two casing halves, the two turbine casings bordering a high-pressure steam space and a low-pressure steam space, the steam spaces being separated from one another by an annular gap defined between the turbine casings, the annular gap being sealed by the seal arrangement, the method comprising replacing the worn seal arrangement in its entirety with a new seal arrangement, wherein at least one segmented ring has a thickness between a bottom of the annular receiving groove and the one of the turbine casings in the region of the annular gap to which the at least one segmented ring is releasably attached or wherein the seal element is part of one segmented ring, and wherein the at least one segmented ring has a constant width from the first circumferential surface of the at least one segmented ring to the opposite second circumferential surface of the at least one segmented ring.

* * * * *